US005946779A

United States Patent [19]

Chen

[11] Patent Number: 5,946,779

[45] Date of Patent: Sep. 7, 1999

[54] SHOELACE HAVING SECTIONS OF DIFFERENT DIAMETERS AND DENSITIES

[75] Inventor: Paul Chen, Changhua Hsien, Taiwan

[73] Assignee: Taiwan Paiho Limited, Changhua Hsien, Taiwan

[21] Appl. No.: 09/113,359

[22] Filed: Jul. 10, 1998

[51] Int. Cl.[6] ..... A45C 1/00

[52] U.S. Cl. ..... 24/712; 24/713

[58] Field of Search ..... 24/712, 713, 713.1, 24/715.3–715.7, 18, 34; 2/270; 36/50.1; 402/8

[56] References Cited

U.S. PATENT DOCUMENTS

| | | | |
|---|---|---|---|
| 931,949 | 8/1909 | Morrow | 24/712 |
| 2,141,801 | 12/1938 | Taft | 24/713 |
| 3,110,945 | 11/1963 | Howe, jr. | 24/713 |
| 4,247,967 | 2/1981 | Swinton | 24/713 |
| 4,764,119 | 8/1988 | Miraglia | 24/712 X |
| 4,930,196 | 6/1990 | Laurin | 24/715.3 |

*Primary Examiner*—Victor N. Sakran
*Assistant Examiner*—Robert J. Sandy
*Attorney, Agent, or Firm*—Bacon & Thomas

[57] ABSTRACT

An improved shoelace having two tying sections with an elongated stringing section disposed therebetween. Each tying section has a larger diameter and lower density than the elongated stringing section so as to permit the stringing section to smoothly run through a plurality of string through holes of a shoe with less friction against the rims of the through holes in use, resulting in the advancement of durability of a shoelace in one aspect and the facility of tying of a shoelace into a butterfly knot in another aspect.

2 Claims, 3 Drawing Sheets

SHOELACE HAVING SECTIONS OF DIFFERENT DIAMETERS AND DENSITIES

BACKGROUND OF THE INVENTION

The present invention relates to an improved shoelace having two tying sections with an elongated stringing section disposed therebetween. Each tying section has a larger diameter and smaller density than the elongated stringing section so as to permit the stringing section to smoothly run through a plurality of string through holes of a shoe with less friction against the rims of the through holes in use, resulting in the advancement of durability of a shoelace in one aspect and the facility of tying of a shoelace in another aspect.

Referring to FIG. 1, a conventional shoelace has a shoelace embodiment 10 of an identical diameter at its full length and is provided with a squeezedly fixed plastic cap 11 at each end thereof. The diameter of the shoelace embodiment 10 is approximately identical to that of string through holes or buckles 21 of a shoe 20. Such a prior art shoelace is subject to excessive friction against the rims of the string through holes 21 when the shoelace is pulled and tied into a butterfly knot repeatedly in practical use, resulting in the breaking or wearing of fibers of the shoelace readily, as shown in FIG. 2.

Such a conventional shoelace has the following disadvantages:

1. The durability of the shoelace is poor as a result of the relatively large diameter and low density of the shoelace embodiment 10, causing the fibers of the shoelace to be easily worn out via excessive friction in operation against the rims of the string through holes 21 of a shoe 20.
2. The shoelace is not smoothly managed and a person must exert relatively large force to pull the same in extension for tying a butterfly knot due to the excessive friction among the shoelace and the rims of the string through holes.

SUMMARY OF THE INVENTION

Therefore, the primary object of the present invention is to provide an improved shoelace having sections of different diameters and densities which includes two tying ends having a relatively large diameter and a stringing section having a smaller diameter than the tying ends and a larger density than the tying ends so that the stringing section of the shoelace can be loosely engaged with string through holes of shoes without serious friction against the rims of through holes, causing easy breaking of shoelaces.

Another object of the present invention is to provide an improved shoelace which is easy to string through the through holes of a shoe in one aspect and is fast tied up in practical use as a result of less friction among the shoelace and through holes in another aspect.

DETAILED DESCRIPTION OF THE PREFERRED EMBODIMENT

Figure 1:
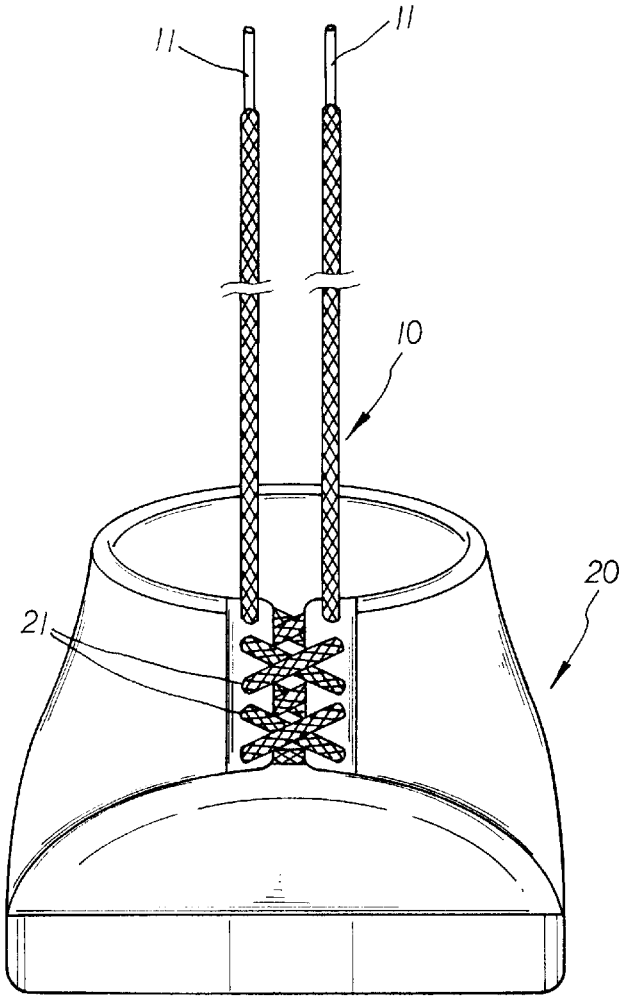
FIG. 1 PRIOR ART
FIG. 1 is a diagram showing a conventional shoelace tied up to one shoe.
Figure 2:
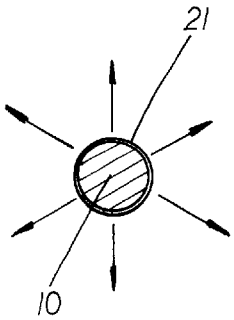
FIG. 2 PRIOR ART
FIG. 2 is a sectional diagram showing a prior art shoelace in tight engagement with one of string through holes of a shoe.
Figure 3:
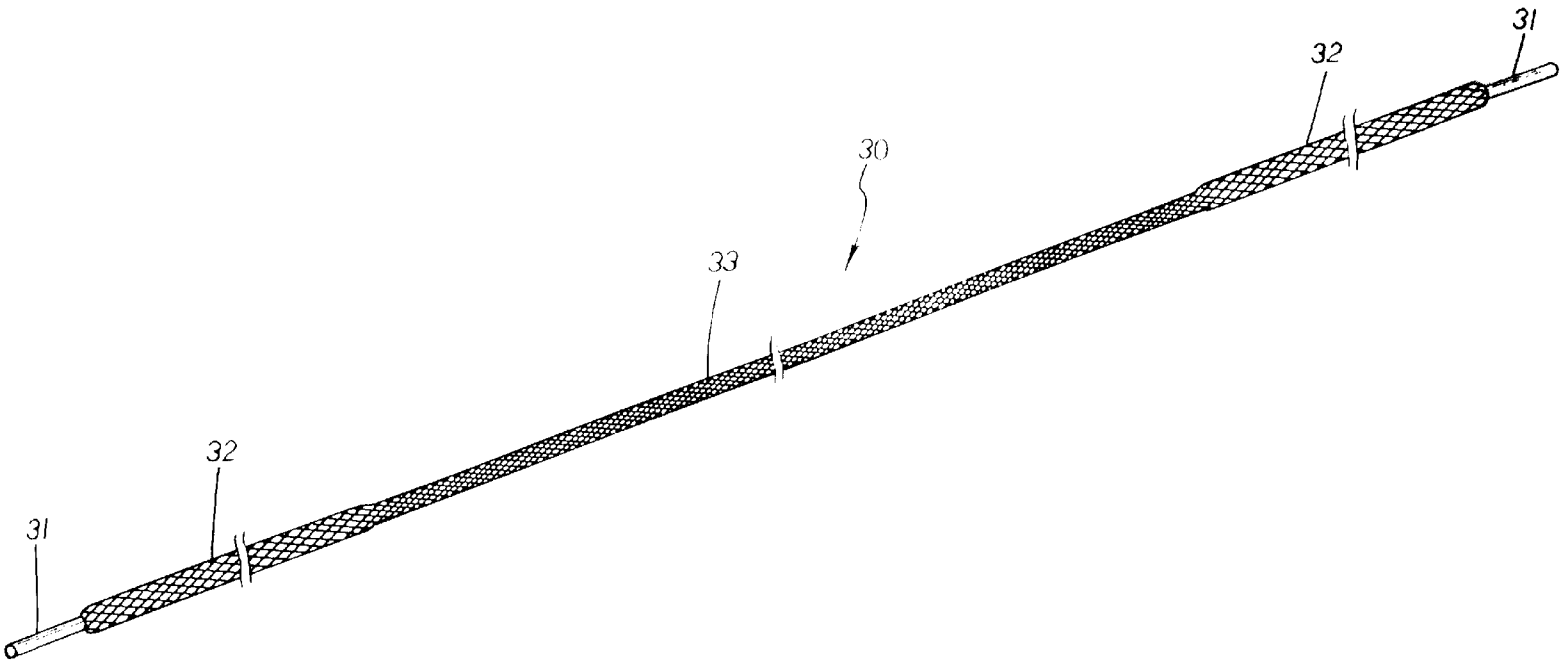
FIG. 3 is a diagram showing a shoelace having sections of different diameters and densities of the present invention.

Referring to FIG. 3, the shoelace of the present invention is comprised of a shoelace embodiment 30 having its two ends each provided with a squeezedly fixed cap 31 connected to a first/second tying section 32 having a first relatively low density and a first, relatively large diameter which is approximately identical to the diameter of string through holes of a shoe. Each tying section 32 is connected to an elongated stringing section 33 having a second, smaller diameter and a second higher density than the tying sections 32.

Figure 5:
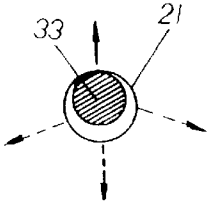
FIG. 5 is a sectional diagram showing the shoelace of the present invention in loose engagement with a string through hole of a shoe.
Figure 4:
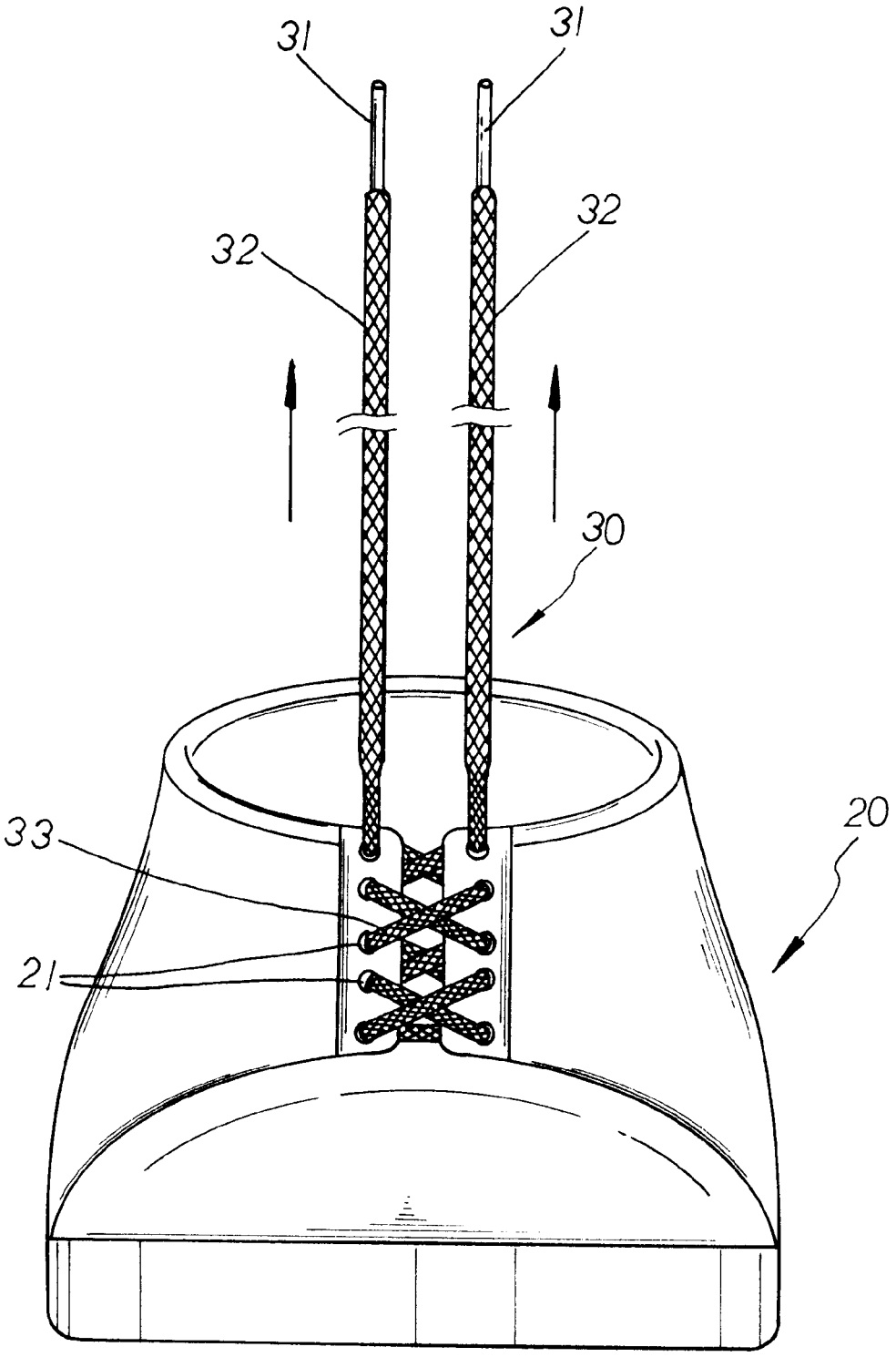
FIG. 4 is a diagram showing the attachment of the shoelace of the present invention to a shoe.

Referring to FIG. 4, in practical use, the two squeezedly fixed cap 31 of the tying sections 32 of the shoelace embodiment 30 are neatly arranged through a plurality of string through holes or buckles 21 of a shoe. When worn on a foot of a person, the two tying sections 32 are pulled tightly and bound into a butterfly knot. The elongated stringing section 33 having a smaller diameter than those of the string through holes 21 is smoothly engaged with the through holes 21 with less friction as shown in FIG. 5 so that the shoelace can be easily managed with improved durability.

It becomes apparent that the shoelace of the present invention has the following advantages in practical use:

1. The elongated stringing section 33 having a reduced diameter is led through the string through holes 21 of a shoe 20 in a smoother manner with less friction produced between the shoelace and the rims of the through holes 21 so that the shoelace is not easily worn out and broken.
2. The elongated stringing section 33 runs smoothly among the string through holes 21 of a shoe 20 so that the pulling of the tying sections 32 can easily get the shoelace tightened up without troubling a person to arrange the stringing section 33 among the string through holes 21.

I claim:

1. A shoelace having sections of different diameters and densities, comprising:

a first tying section at one end of the shoelace, the first tying section having a first diameter and a first density over its entire length and terminating in a first squeezed cap;

a second tying section at the other end of the shoelace, the second tying section also having the first diameter and the first density over its entire length and terminating in a second squeezed cap;

an elongated stringing section disposed between and connecting the first and second tying sections, the stringing section having a second diameter and a second density over its entire length;

wherein the first diameter is larger than the second diameter and the first density is lower than the second density such that when the shoelace is used with a shoe having a plurality of string through holes, the second diameter is smaller than that of the string through holes and the elongated stringing section runs smoothly through the plurality of string through holes when the shoelace is pulled tight and knotted at the first and second tying sections.

2. A shoelace according to claim 1, wherein the first diameter is approximately equal to that of the string through holes.

* * * * *